US010876716B2

(12) United States Patent
Budavari et al.

(10) Patent No.: US 10,876,716 B2
(45) Date of Patent: Dec. 29, 2020

(54) TOOL-LESS LIGHT FIXTURE

(71) Applicant: Schreder S.A., Brussels (BE)

(72) Inventors: Peter Budavari, Nyergesujfalu (HU); Csaba Horvath, Budapest (HU); Péter Balázs Bedo, Budapest (HU); Peter Pelbart, Eger (HU)

(73) Assignee: Schreder S.A., Brussels (BE)

( * ) Notice: Subject to any disclaimer, the term of this patent is extended or adjusted under 35 U.S.C. 154(b) by 0 days.

(21) Appl. No.: 16/614,129

(22) PCT Filed: May 8, 2018

(86) PCT No.: PCT/EP2018/061908
§ 371 (c)(1),
(2) Date: Nov. 15, 2019

(87) PCT Pub. No.: WO2018/210642
PCT Pub. Date: Nov. 22, 2018

(65) Prior Publication Data

US 2020/0116336 A1 Apr. 16, 2020

(30) Foreign Application Priority Data

May 16, 2017 (BE) ..... 20175362

(51) Int. Cl.
*F21S 4/00* (2016.01)
*F21V 17/16* (2006.01)
(Continued)

(52) U.S. Cl.
CPC ..... *F21V 17/164* (2013.01); *F21S 8/04* (2013.01); *F21V 15/015* (2013.01);
(Continued)

(58) Field of Classification Search
USPC ..... 362/217.12
See application file for complete search history.

(56) References Cited

U.S. PATENT DOCUMENTS

2006/0146531 A1* 7/2006 Reo ..... F21V 29/767 362/244
2009/0021936 A1* 1/2009 Stimac ..... F21S 4/28 362/249.02
(Continued)

FOREIGN PATENT DOCUMENTS

DE 102009026095 A1 1/2011
EP 2650594 A1 10/2013
(Continued)

OTHER PUBLICATIONS

PCT International Search Report, PCT International Application No. PCT/EP2018/061908, dated Jun. 19, 2018, 12 pages.

*Primary Examiner* — Ali Alavi
(74) *Attorney, Agent, or Firm* — McDonnell Boehnen Hulbert & Berghoff LLP

(57) ABSTRACT

A lighting fixture comprising: an elongate housing having an outer surface and an inner surface and having an elongate opening extending in a longitudinal direction of the housing; wherein the elongate housing comprises a first wall and a second wall extending towards the elongate opening; a light module for emitting light having a first face through which light is emitted and an opposite second face; a plurality of retainer means provided at the second face and configured for engaging the first and second walls such that the light module is retained within the elongate housing; a stopper means for preventing inward displacements of the light module past a predetermined boundary.

22 Claims, 4 Drawing Sheets

(51) Int. Cl.

| | |
|---|---|
| ***F21V 29/70*** | (2015.01) |
| ***F21S 8/04*** | (2006.01) |
| ***F21V 15/015*** | (2006.01) |
| ***F21V 17/00*** | (2006.01) |
| ***F21V 17/04*** | (2006.01) |
| ***F21V 23/00*** | (2015.01) |
| *F21Y 115/10* | (2016.01) |
| *F21V 31/00* | (2006.01) |
| *F21Y 103/00* | (2016.01) |

(52) U.S. Cl.

CPC ..... *F21V 17/002* (2013.01); *F21V 17/04* (2013.01); *F21V 23/003* (2013.01); *F21V 29/70* (2015.01); *F21V 31/005* (2013.01); *F21Y 2103/00* (2013.01); *F21Y 2115/10* (2016.08)

(56) References Cited

U.S. PATENT DOCUMENTS

| | | | | |
|---|---|---|---|---|
| 2009/0219713 | A1* | 9/2009 | Siemiet | F21V 29/76<br>362/218 |
| 2009/0290348 | A1* | 11/2009 | Van Laanen | F21V 3/02<br>362/249.02 |

FOREIGN PATENT DOCUMENTS

| | | | |
|---|---|---|---|
| EP | 2650607 | A1 | 10/2013 |
| EP | 2827053 | A1 | 1/2015 |
| EP | 2899451 | A1 | 7/2015 |
| GB | 2543757 | A | 5/2017 |

* cited by examiner

TOOL-LESS LIGHT FIXTURE

CROSS-REFERENCE TO RELATED APPLICATION

The present application is a national stage entry of PCT/EP2018/061908 filed May 8, 2018, which claims priority to BE 20175362 filed on May 16, 2017, the contents of each of which are hereby incorporated by reference.

FIELD OF INVENTION

The present invention relates to light fixtures. Particular embodiments relate to a light fixture for mounting light modules in a tool-less manner.

BACKGROUND

Typically, lighting equipment in public places uses lighting fixture such as screws or any other components requiring a tool for the installation of a light module. The need of a tool reduces the practicality of the light fixture and can be time-consuming. This becomes especially relevant as a large number of light modules needs to be installed and/or removed, which is often the case in public places. One needs a less costly lighting fixture in terms of installation time that also maintains the safety required for a use in a public environment.

Many solutions exist for indoor lighting equipment presenting a lighting fixture comprising holding hooks for example provided in the lighting housing for a tool-less installation. However tool-less lighting fixture mounted on the light module are not known at the time of the present invention, even though it would quicken the installation manipulation. At the same time it would lessen the number of parts in the lighting housing since most parts would be directly mounted on the light module. One can also take advantage of the supplementary retaining surfaces it requires in the lighting housing to design additional functionalities within the lighting housing. Hence there is a need for a tool-less lighting fixture presenting these characteristics.

SUMMARY

The object of embodiments of the invention is to provide a lighting fixture easier to use and allowing faster installation and replacement of a light module. More in particular, embodiments of the invention aim to provide a lighting fixture which allow for a tool-less installation of a light module.

According to a first aspect of the invention there is provided a lighting fixture. The lighting fixture comprises:

- an elongate housing having an outer surface and an inner surface and having an elongate opening extending in a longitudinal direction of the housing;
- wherein the elongate housing comprises a first wall and a second wall extending towards the elongate opening;
- a light module for emitting light having a first face through which light is emitted and an opposite second face;
- a plurality of retainer means provided at the second face of the light module and configured for engaging the first and second walls such that the light module is retained within the elongate housing;
- a stopper means for preventing inward displacements of the light module past a predetermined boundary.

Embodiments of the invention are based inter alia on the insight that a common solution to fix lighting equipment to a ceiling or any other surface is done with screws or any other components for which there is a need to use tools. In the case that there is a housing to house a light module, one has to fix the light module within the housing. An elongate housing is the preferred solution to be able to house several light modules for instance. To overcome the problem of having to use tools to fix the light module, a modification has first to be done to the elongate housing. A first wall and a second wall will be added to the elongate housing, extending towards the elongate opening through which the light module will be mounted. The first and second walls will serve several purposes, the main one being a support for the mounting of the light module. A plurality of retainer means is provided on the face of the light module opposite to the one transmitting light. The plurality of retainer means engages with the first and second wall in a way allowing easy installation of the light module by a "plugging and pushing" assembly. A stopper means is implemented to stop inward displacements of the light module past a predetermined boundary. This stopper means stops displacements to prevent "over-pushing" the light module in the housing during its installation and to keep the plurality of retainer means in their optimal positioning. It may also prevent inward displacements in the event of an accidental external impact happening, e.g. a person or object hitting the light module. In practice the stopper means can be implemented in various ways.

According to a preferred embodiment, the plurality of retainer means comprises at least a first spring element and a second spring element having a protruding portion snap-fitted behind a first ridge and a second ridge at the first wall and the second wall, respectively, when looking from the elongate opening in the direction of the inner surface.

In this manner, a reliable means of retaining the light module is achieved. Indeed snap-fitting, by its mechanical simplicity, ensures that there is a lower probability of unforeseen problems arising.

Additionally the spring element dimensions and protruding portion can be easily modified and manufactured to adapt to various needs regarding a certain force required for the mounting or removal of the light module for instance. A first and a second spring element are provided on both longitudinal sides of the light module to retain it in a balanced way such that the retaining forces are spread equally among the plurality of retainer means. The first and second spring element may be provided symmetrically and their positioning may be further optimized to improve the mounting balance of the light module. These two spring elements can be independent from each other or be two portions of a common element for ease of fabrication. The protrusion of the curved portion is designed depending on the weight of the light module, the number of retainer means used, the dimensions of the first and the second ridge, the fabrication method of the retainer means, and the material of the retainer means.

According to an exemplary embodiment, the spring element comprises a first portion extending upwardly from the second face of the light module. The protruding portion is a curved portion formed at an upper edge of the first portion.

In this way, the first portion of the spring element is better designed for an installation of the light module at the ceiling, the light module being suspended from the curved portion of each spring element engaged against the first and the second wall behind the first and the second ridge, respectively. A curved-shaped spring element is preferred with respect to a more acute shape because of simpler manufacturing.

According to a preferred embodiment, the stopper means comprises at least one element configured for engaging an edge of the first and the second wall.

In this manner, the first and second wall will also serve a second purpose. Their respective edge will be a limiting surface onto which the stopper means will engage.

According to an exemplary embodiment, the stopper means is configured to prevent further inward displacements of the light module when the protruding curved portion of each of the plurality of retainer means is behind the first and second ridge.

In this way, only minimal displacements of the light module within the housing are possible. Inward displacements are limited by the stopper means, and outward displacements are limited by the position of the protruding curved portion of each of the plurality of retainer means with respect to the first and second ridge.

According to a preferred embodiment, the light module has a first and a second longitudinal side extending in the longitudinal direction, and a first and a second lateral side extending between the first longitudinal side and the second longitudinal side. The at least one element of the stopper means comprises a first lateral edge at the first lateral side of the light module extending from the second surface of the light module in direction of the first and second wall, and a second lateral edge at the second lateral side of the light module extending from the second surface of the light module in direction of the first and second wall.

In this manner, the light module has a similar shape as the elongate opening to fit in the elongate housing. The first and second lateral edge comprised in the stopper means permit a more secure protection against external impact since it provides additional stopping contacts in a balanced way against the first and second wall. Additionally it prevents direct contact of the second face of the light module against the first and second wall, adding supplementary protection to the contents of the light module.

According to an exemplary embodiment, the light module comprises:

- a support substrate, preferably a printed circuit board, with at least one LED disposed thereon;
- a lighting housing comprising a base portion and a cover; said cover extending over the at least one LED and being fixed to said base portion.

Optionally the light module further comprises:

- a lighting plate containing a thermally conductive material and having a first surface and a second surface, wherein the support substrate is provided on the second surface of the lighting plate, wherein the first surface of the lighting plate faces the base portion of the lighting housing.

In this way, a light source in the way of a printed circuit board with at least one LED is contained by a lighting housing. The printed circuit board may be mounted on a lighting plate to diffuse any excessive heat produced by the light source. The light source could also be a source other that a LED, e.g. halogen, incandescent, or fluorescent lamp. The surface onto which the printed circuit board is mounted can be made reflective to improve the light emission. To enclose and protect the light source, a cover is positioned over the at least one LED by, for instance, snap-fitting it to the base portion of the lighting housing. This cover may be in a transparent or translucent material depending on the use of the light module and the quality of lighting required. The base portion is designed to contain the lighting plate and the printed circuit board with at least one LED. The light module comprises a first face through which light is emitted and an opposite second face. The light module may also be designed in such a way that the second face of the light module can serve as a mounting surface for different elements, e.g. retainer means, stopper means, electronic components, etc.

According to a preferred embodiment, at least one electric component is mounted on the second face of the light module such that the at least one electric component is located in a space within the bounds of the inner surface of the elongate housing, the first and second walls, and the second face of the light module.

In this manner, the first and the second wall will serve one more purpose. They will become part of an enclosed space protecting the at least one electric component. The space within the bounds of the inner surface of the elongate housing, the first and second walls, and the second face of the light module thus effectively define a protected channel against unwanted external intrusions. One could modify the first and second lateral edge of the stopper means to a peripheral edge extending from the perimeter of the second surface of the light module in direction of the first and second wall. This peripheral edge would be more effective at preventing water intrusion for example.

According to an exemplary embodiment, a second light module is retained longitudinally adjacent to a first light module by another plurality of retainer means within the elongate housing.

In this way, a same elongate housing can be used to house several light modules thus being a more economical solution and allowing a less time-consuming installation of the light modules. For safety reasons, in the case where several light modules are adjacently mounted, removal of the first light module may require the use of a tool, preferably a suction tool. Subsequent light modules may be removed by a simple application of force. A gap may be provided on a light module side to allow an operator to remove the first light module by hand only.

According to a preferred embodiment, a lighting driver is mounted on the second face of the first light module, wherein the lighting driver is configured to control the provision of power to the at least one LED of the first light module and the second light module.

In this manner, less electronic components are necessary for longitudinally adjacent light modules. Only additional connections between the first and second light modules are needed without having to install more electronic components on the second surface of the second light module. Having only one driver driving the first and second light modules may be more economical and less time-consuming. One could also use the lighting driver mounted on the first light module to drive more than two light modules.

According to an exemplary embodiment, at least the first or second wall is composed of a first portion of the elongate housing extending towards the elongate opening and joining to another second portion of the elongate housing extending at an angle of the first portion.

In this way, the first and second wall used to support the plurality of retainer means can be integrated in the outer profile of the elongate housing to save material. By adding housing portions to the elongate housing and integrating the first and second wall in the outer profile, one can multiply the uses of the first and second wall and create an external compartment to hide power cables and other wires. This would improve the aesthetics of the light equipment.

According to a preferred embodiment, the first face of the light module is designed to align with the outer edges of the elongate opening when mounted within the elongate housing.

In this manner, the light equipment is both more aesthetically pleasing and offers less salient external aspects for an improved safety.

According to an exemplary embodiment, the elongate housing is an extruded profile, preferably in metal.

According to an exemplary embodiment, the elongate housing has a length of more than 1 meter, preferably more than 2 meters, even more preferably more than 3 meters.

In this way, the manufacturing of the elongate housing is simplified and its length can be adjusted easily. Moreover, being in metal, the elongate housing will have a higher durability and an easier maintenance.

According to a preferred embodiment, the cover extends between outer edges of the elongate opening. According to an exemplary embodiment, the cover is located at least partially within the elongate housing. According to a preferred embodiment, the base portion is located entirely within the elongate housing. According to an exemplary embodiment, the cover is located at least partially out of the elongate housing. According to a preferred embodiment, the support substrate is located entirely within the elongate housing.

Embodiments of the invention aim at providing a lighting fixture with a reliable and secure installation of the light module within the elongate housing. To achieve that, the skilled person will understand that careful positioning of the different elements of the light module relative to the elongate housing is needed. The cover being generally the most vulnerable external element of the light module, placing it between outer edges of the elongate opening and/or such that part of the cover is located within the elongate housing allows to take advantage of the lateral protection offered by the elongate housing as well as reducing its exposure to external damaging elements. Placing it at least partially out of the elongate housing allows to increase the possibilities of diffusing light from the light module. Moreover, attention to the base portion may also be needed since it may hold and/or carry critical electronic elements of the light module as well as the support substrate. As such, placing them both entirely within the elongate housing permits to limit unwanted access to these critical electronic elements.

The skilled person will understand that the hereinabove described technical considerations and advantages for fixture embodiments also apply to the below described corresponding module embodiments, mutatis mutandis.

According to an exemplary embodiment, there is provided a light module for use in a lighting fixture. The light module comprises:

- a support substrate, preferably a printed circuit board, with at least one LED disposed thereon;
- a lighting housing comprising a base portion and a cover;
- a lighting plate containing a thermally conductive material and having a first surface and a second surface, wherein the support substrate is provided on the second surface of the lighting plate, wherein the first surface of the lighting plate faces the base portion of the lighting housing;
- said cover extending over the at least one LED and being fixed to said base portion;
- a plurality of retainer means provided on the outer surface of the base portion;
- a stopper means.

BRIEF DESCRIPTION OF THE FIGURES

This and other aspects of the present invention will now be described in more detail, with reference to the appended drawings showing a currently preferred embodiment of the invention. Like numbers refer to like features throughout the drawings.

DESCRIPTION OF EMBODIMENTS

Figure 1:
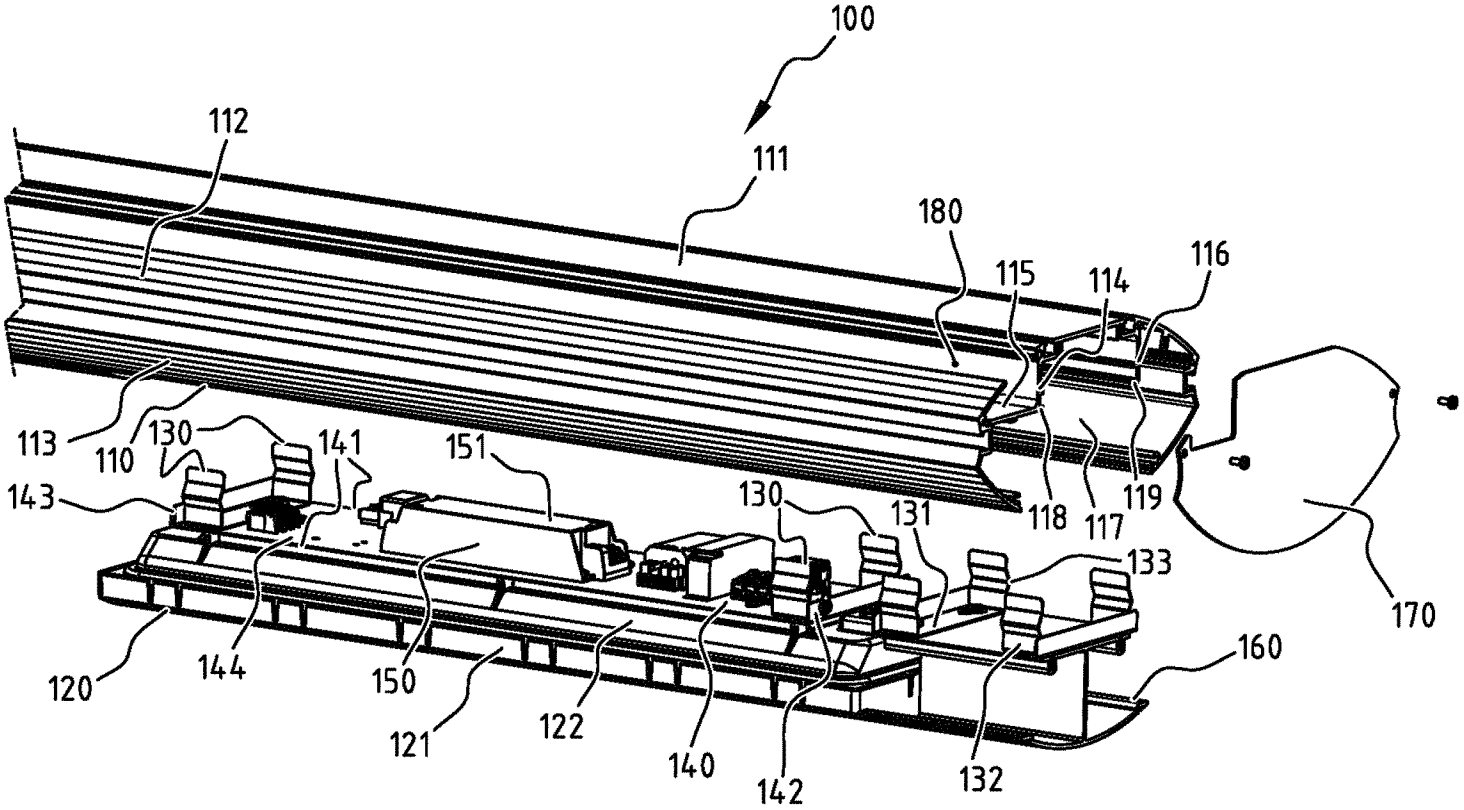
FIG. 1 shows an exploded perspective view of an exemplary embodiment of a lighting fixture according to the invention.
Figure 2A:
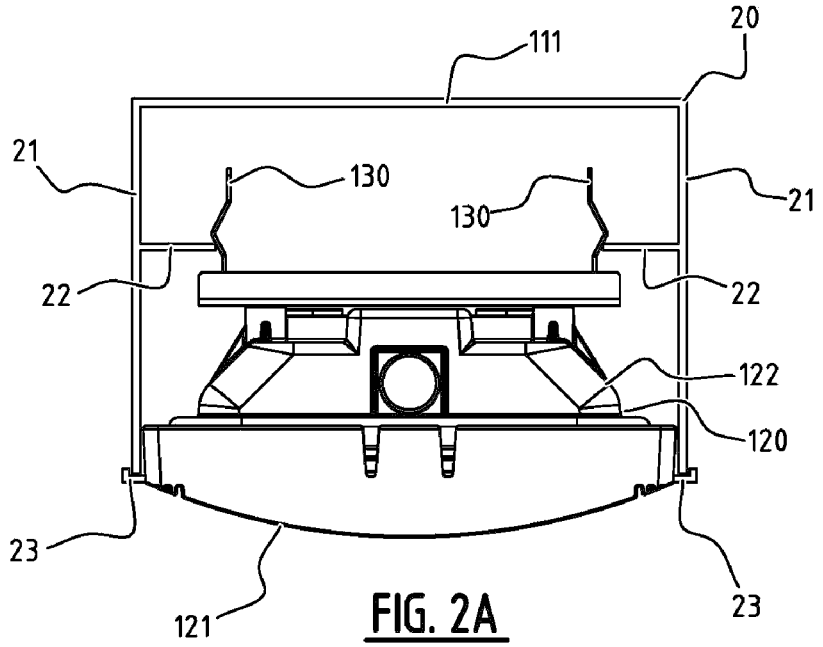
FIGS. 2A and 2B schematically illustrate further exemplary embodiments of a lighting fixture according to the invention.
Figure 2B:
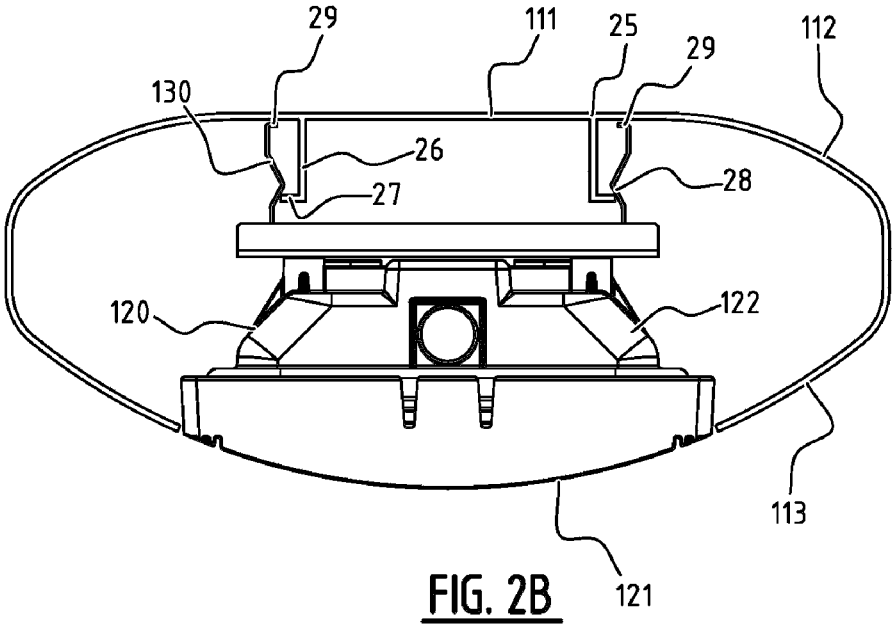

FIG. 1 shows an exploded perspective view of an exemplary embodiment of a lighting fixture according to the present invention. The lighting fixture 100 comprises a housing 110, a light module 120, a plurality of retainer means 130, and a stopper means 140. The housing 110 extends around the light module 120 and comprises a first wall 114 and a second wall 116. The first wall 114 and/or the second wall 116 may be part of an outer casing of the housing or may be inside an outer casing of the housing. In the exemplary embodiment shown in FIG. 1, the first wall 114 is part of the outer casing of the housing 110, and the second wall 116 is inside the outer casing of the housing 110. The skilled person will understand that various designs of the first wall and the second wall can be implemented either inside the outer casing or as part of the outer casing. For example, FIG. 2A illustrates an embodiment where both the first wall 114 and the second wall 116 are part of the outer casing, and FIG. 2B illustrates an embodiment where both the first wall 114 and the second wall 116 are inside the outer casing, as will be described in detail below.

The light module 120 comprises a first face 121 through which light is emitted, and a second face 122 opposite of the first face 121. The plurality of retainer means 130 are provided at the second face 122 of the light module and are configured for engaging the first wall 114 and the second wall 116. A stopper means 140 is implemented to prevent inward displacements of the light module 120 past a predetermined boundary. The housing 110 may comprise a planar support surface 111 to fix the housing to a wall, a first side wall extending from the support surface 111, a second side wall extending from the support surface 111 opposite of the first side wall. The first side wall comprises a first upper wall 112 extending outward and away from the mounting surface, and a first lower wall 113 extending inward and away from the first upper wall 112 and joining to the first upper wall 112. The second side wall comprises the first wall 114 extending away from the support surface 111, a second portion 115 extending outwardly at an angle of the first wall 114 and joining to the first wall 114, and a second lower wall 117 extending in a symmetrical manner as the first lower wall 113. Thus an elongate opening is formed by the edges of the first lower wall 113 and the second lower wall 117. An external compartment 180 is defined by the first wall 114, the second portion 115 of the second side wall, and a portion of the outer casing. This external compartment 180 may be used to contain additional electronic or non-electronic devices, e.g. wires. A second wall 116 extends from the support surface 111 towards the elongate opening and parallel to the first wall 114. There may be a first ridge 118 at the joining of the first wall 114 and the second portion 115, and a second ridge 119 at the extremity of the second wall 116. As will be explained below, the first ridge 118 and the second ridge 119 are intended for cooperating with the plurality of retainer means 130. The elongate housing 110 shown in FIG. 1 may be made in one piece, preferably by extrusion, e.g. from aluminum. In another example the elongate housing 110 may be fabricated from a metal sheet by cutting and/or folding and/or welding.

The light module 120 has a first face 121 through which light is emitted. The first face may be a plate composed of a transparent or translucent material. A second face 122 of the light module opposite of the first face 121 may be a cup-shaped plate, e.g. made of plastic.

A plurality of retainer means 130 may be provided at the second face of the light module 122. FIG. 1 shows two pairs of retainer means 130 provided at each longitudinal end of the light module 120. The plurality of retainer means 130 engages with the first ridge 118 and the second ridge 119 such that the light module 120 onto which they are mounted can be retained within the elongate housing 110. The plurality of retainer means comprises at least a first spring element and a second spring element. The spring element is composed of a flat portion 132, and of a curved portion 133. The flat portion 132 extends away from the second face 122 of the light module. The curved portion 133 which protrudes outwardly adjoins to the upper edge of the flat portion 132. Upon pushing the light module within the housing 110, the associated retainer means protruding curved portion 133 enters in contact with the ridge, pushing the spring element out of its resting position. Once the protruding portion 133 is past the ridge, the spring element returns to its resting position, being snap-fitted, thus preventing the light module 120 from getting out of the elongate housing from only the pull of gravity. The retainer means may comprise a main body with a planar mounting surface 131 fixed to the second face 122 of the light module, two parallel longitudinal sides, and two parallel transverse sides. A pair of spring elements comprising a flat portion 132 and a curved portion 133 may be joined to the two transverse sides of the planar mounting surface 131. Two pairs of spring elements will preferably be provided to the light module, but one pair or more than two pairs of spring elements are also possible. The plurality of retainer means 130 can be designed so that the light module associated to them resists up to a pulling force equivalent to three times the weight of the light module 120, preferably four times. The retainer means may be in metal, preferably in spring steel. Note that the use of spring elements allows for the installation and removal of the light module to be achieved without a specific tool.

The stopper means 140 role is to prevent inward displacement of the light module past a predetermined boundary. The stopper means 140 comprises at least one element for engaging an edge of the first wall 114 and the second wall 116. The stopper means 140 may be configured to prevent further inward displacements of the light module 120 when the protruding curved portion 133 of each of the plurality of retainer means 130 is behind the first ridge 118 and the second ridge 119. The stopper means 140 may have a first and a second longitudinal side 141 extending in the longitudinal direction, and a first and a second lateral side 142 extending between the first longitudinal side and the second longitudinal side 141. The stopper means may comprise a first and a second lateral edge 143 at the first and the second lateral side 142 of the stopper means, respectively. The first and the second edge 143 engage with the edge of the first wall 114 and the edge of the second wall 116. The first and the second edge 143 may be designed so that the engagement occurs when the protruding curved portion 133 of each of the plurality of the retainer means is past the first ridge 118 and the second ridge 119. FIG. 1 shows an exemplary embodiment of a stopper means 140 provided at the second face 122 of the light module. A planar mounting surface 144 allows the stopper means to be mounted on the second face 122 of the light module. The stopper means 140 associated to the light module 120 may be designed to respect the IK08 certification relative to external impact, preferably IK10.

At least one electronic component may be mounted to the second face 122 of the light module. A driver 151 to drive at least one light module 120 might be the at least one electronic component. The at least one electronic component is mounted such that it may be located in a space within the bounds of the mounting inner surface 111 of the elongate housing, the first wall 114, the second wall 116, and the mounting surface 144 of the stopper means. The at least one electronic component may be fixed in a gear tray 150 provided to the mounting surface 144 of the stopper means or to the second face 122 of the light module.

To adjust the longitudinal position of the light module 120 within the elongate housing, a spacer block 160 may be used. The spacer block 160 can be mounted within the elongate housing using a similar stopper means 140 and retainer means 130 as the light module 120. To complete the enclosure of the light module within the elongate housing, cover plates 170 may be fixed to each open end of the elongate housing extruded profile. The spacer block 160 may be designed in extruded metal, preferably aluminum, to align with the outer edges of the elongate opening when mounted within the elongate housing 110.

FIGS. 2A and 2B schematically illustrate further exemplary embodiments of a lighting fixture according to the present invention. FIG. 2A shows an exemplary embodiment of the lighting fixture comprising a housing 20 extending around a light module 120 and comprising a first and a second side wall 21 being part of the outer casing of the housing 20. A first and a second ridge 22 are at the inner surface of the first and the second side wall 21. A light module 120 with a plurality of retainer means 130 provided at the second face 122 of the light module is mounted within the housing 20 by engaging the plurality of retainer means 130 with the first and the second ridge 22. A stopper means 23 is provided at the light module 120 to engage with the first and the second side wall 21. The housing 20 may consist of a support planar surface 111 with a first and second longitudinal side, and a first and second transverse side extending between the first and second longitudinal side. Extending away from the support surface 111 on the first and the second longitudinal side are the first and the second side wall 21.

FIG. 2B shows another further exemplary embodiment of the lighting fixture according to the present invention comprising a housing 25. The housing 25 comprises a first side wall and a second side wall extending around the light module 120 and defining an outer casing. The outer edges of the first and the second side wall form an opening. A first and a second wall 26 extend towards the opening from the inner surface of the housing 25. The first wall may be arranged in the outer casing such that a compartment delimited by the outer casing and the first wall is created. This compartment may be used for placing additional electronic or non-electronic components, e.g. wires. A first and a second ridge 27 may be at the extremity of the first and second wall 26. A first and second retainer means provided at the second face 122 of the light module 120 may comprise a first portion extending away from the second face 122 of the light module and a curved portion 28 at the upper edge of the first portion so as to be able to engage the first and second ridge 27. A stopper means 29 designed to prevent further inward displacements of the light module 120 after the protruding portion 28 of the retainer means is past the ridge 27 is provided at the extremity of each of the plurality of retainer means 130. At the upper edge of the protruding portion 28 there might be a third portion extending further away from the second face 122 to which end is a fourth portion 29 at an angle of the third portion. The stopper means is performed by the fourth portion 29 which may be designed so that it enters in contact with the inner surface of the housing 25 in the case of an inward displacement of the light module past a predetermined boundary. The housing 25 may have a planar support surface 111 extending longitudinally with a first and second longitudinal side, and a first and second transverse side extending between the first and second longitudinal side. Extending outward and away on the first and second longitudinal side of the support surface 111, there can be a first and second upper wall 112. Adjoined to the first and second upper wall 112, a first and second lower wall 113 may extend inward and away from the first and second upper wall 112. The first and the second ridge 27 may extend outwardly to match the first and the second curved portion 28 of the retainer means protruding inwardly.

Figure 3:
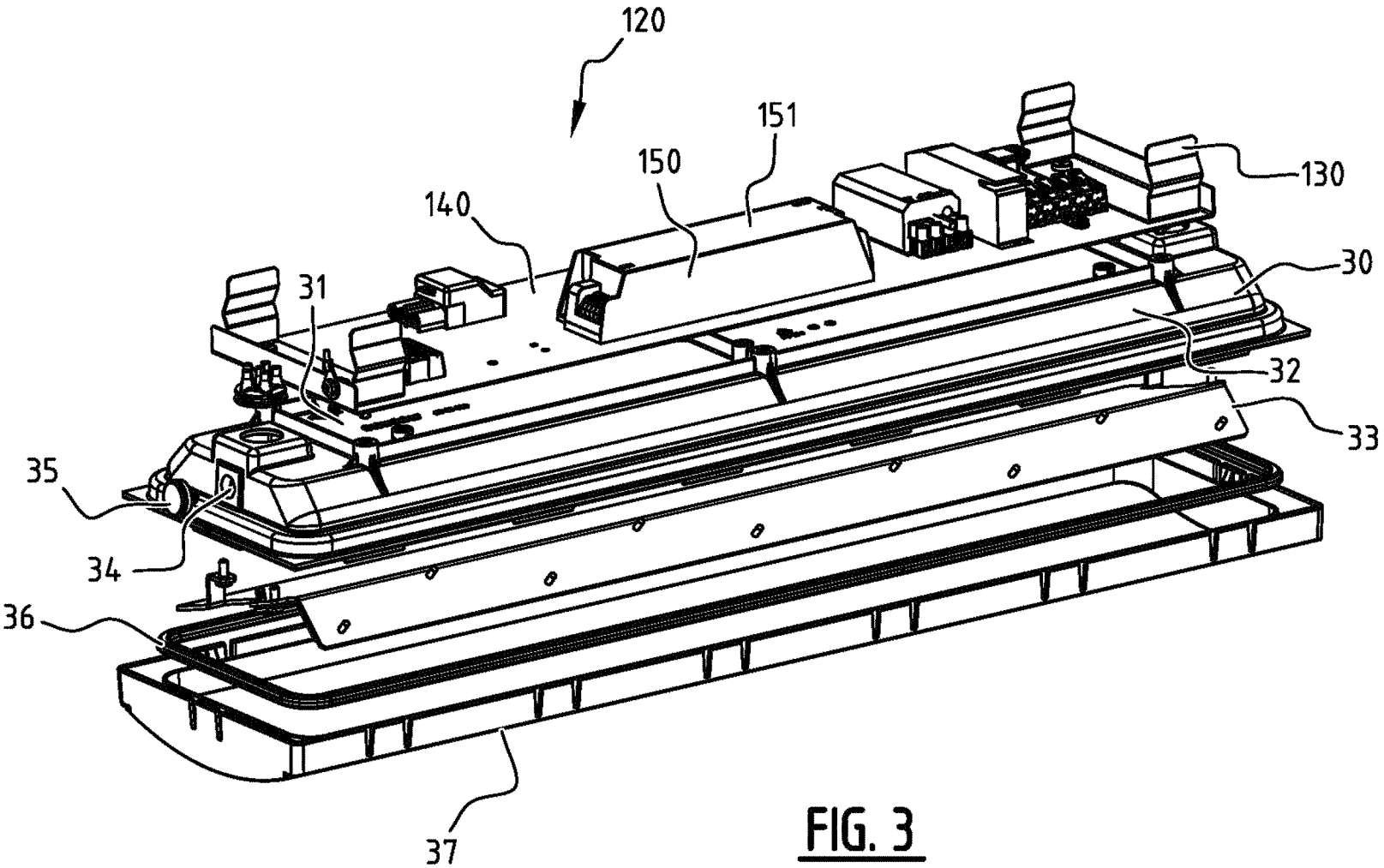
FIG. 3 shows an exploded perspective view of an exemplary embodiment of a light module according to the invention.

FIG. 3 shows an exploded perspective view of an exemplary embodiment of a light module according to the present invention. The light module 120 comprises a base portion 30, a cover 37, and lighting components. The lighting components comprise a lighting plate 33, and a printed circuit board with at least one LED disposed thereon mounted on the lighting plate 33. The cover 37 extends over the at least one LED. To insure against water leaking in the base portion 30, one may have a rubber 36 placed over the outer edge of the base portion 30. The base portion 30 may comprise a planar mounting surface 31 upon which can be mounted a stopper means 140 for example and/or a plurality of retainer means 130. A housing edge 32 extending from the perimeter of the mounting surface houses the lighting components. The planar mounting surface 31 may extend longitudinally, and the housing edge 32 may extend longitudinally and comprises a first and second transverse side. A rounded venting hole 34 can be on the first or second transverse side to allow venting of the inner space of the base portion 30. The venting hole 34 may be plugged by a fitting rounded vent cap 35. The cover may be snap-fitted to the outer edge of the housing edge 32 for easier mounting.

Figure 4:
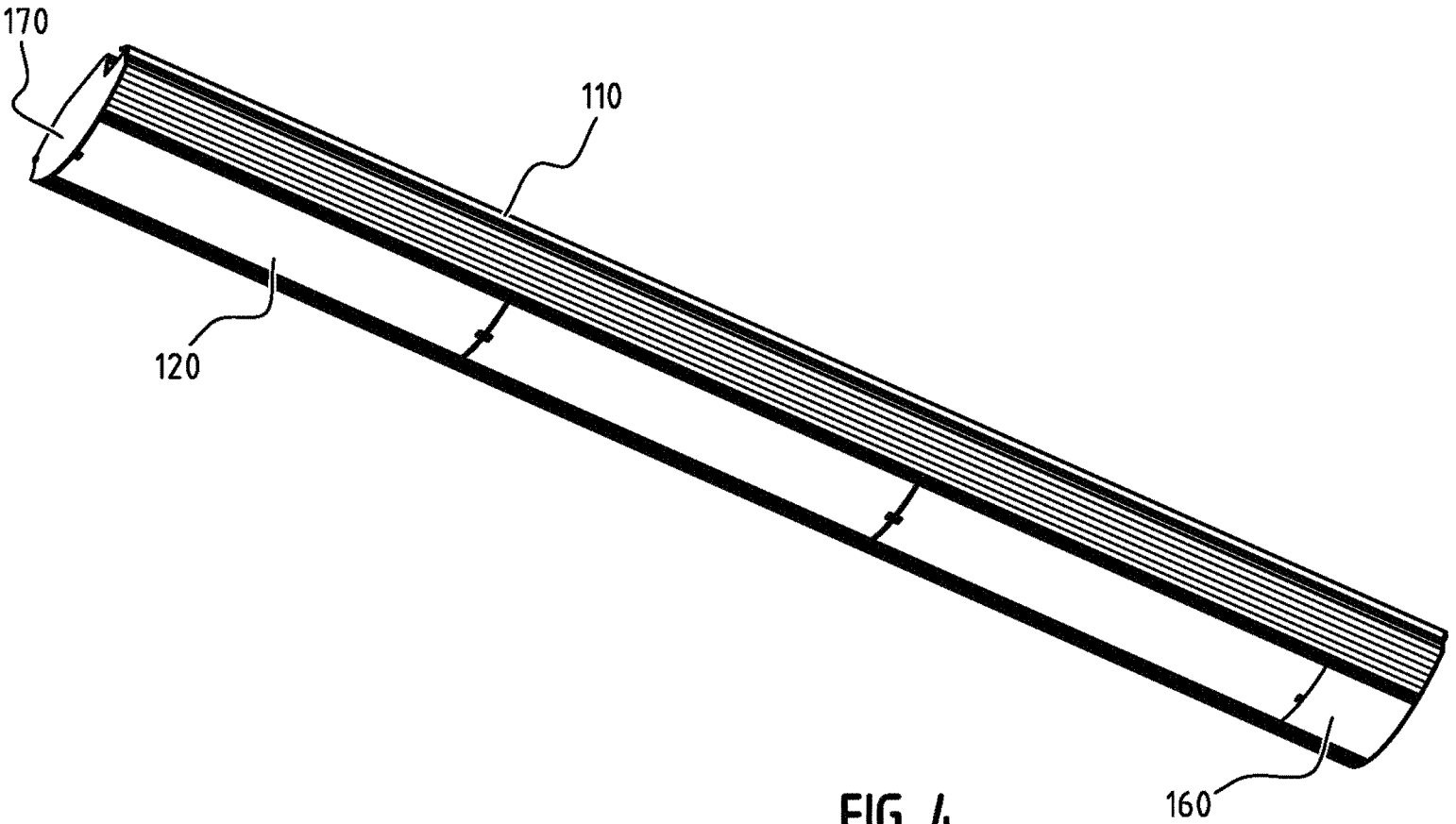
FIG. 4 shows a perspective view of an exemplary embodiment of a lighting fixture comprising a plurality of light modules according to the invention.

FIG. 4 shows a perspective view of an exemplary embodiment of a lighting fixture comprising a plurality of light modules according to the present invention. In the exemplary embodiment shown in FIG. 4, the elongate housing 110 is a rail-like profile. A metal cover plate 170, preferably steel, may be fixed at each end of the elongate housing 110. The elongate housing 110 may contain at least two longitudinally adjacent light modules 120 driven by at least one driver mounted on the second face 122 of the light modules. In the exemplary embodiment shown in FIG. 4, the elongate housing 110 may contain three light modules 120. In another example, the elongate housing is a housing in extruded aluminum of more than 1 meter long, preferably more than 4 meters long, even more preferably more than 5 meters long. Thus it can contain four light modules 120 longitudinally adjacent and grouped in two groups of two light modules separated by a spacer block 160 to adjust for the length of the elongate housing. The four light modules 120 may be driven by at least one driver, preferably only one driver, mounted on the second face 122 of one of the light modules.

The invention claimed is:

1. A lighting fixture comprising:

an elongate housing having an outer surface and an inner surface and having an elongate opening extending in a longitudinal direction of the housing;

wherein the elongate housing comprises a first wall and a second wall extending towards the elongate opening;

a light module for emitting light having a first face through which light is emitted and an opposite second face;

a plurality of retainer means provided at the second face and configured for engaging the first and second walls such that the light module is retained within the elongate housing;

a stopper means for preventing inward displacements of the light module past a predetermined boundary.

2. The fixture of claim 1, wherein the plurality of retainer means comprises at least a first spring element and a second spring element having a protruding portion snap-fitted behind a first ridge and a second ridge at the first wall and the second wall, respectively, when looking from the elongate opening in the direction of the inner surface.

3. The fixture of claim 2, wherein the spring element comprises a first portion extending upwardly from the second face of the light module;

and wherein the protruding portion is a curved portion formed at an upper edge of the first portion.

4. The fixture of claim 1, wherein the stopper means comprises at least one element configured for engaging an edge of the first and the second wall.

5. The fixture of claim 3, wherein the stopper means is configured to prevent further inward displacements of the light module when the protruding curved portion of each of the plurality of retainer means is behind the first and second ridge.

6. The fixture of claim 1, wherein the light module has a first and a second longitudinal side extending in the longitudinal direction, and a first and a second lateral side extending between the first longitudinal side and the second longitudinal side;

and wherein the at least one element of the stopper means comprises a first lateral edge at the first lateral side of the light module extending from the second face of the light module in direction of the first and second wall, and a second lateral edge at the second lateral side of the light module extending from the second face of the light module in direction of the first and second wall.

7. The fixture of claim 1, wherein the light module comprises:

a support substrate with at least one LED disposed thereon;

a lighting housing comprising a base portion and a cover;

said cover extending over the at least one LED and being fixed to said base portion.

8. The fixture of claim 7, wherein the light module further comprises:

a lighting plate containing a thermally conductive material and having a first surface and a second surface, wherein the support substrate is provided on the second surface of the lighting plate, wherein the first surface of the lighting plate faces the base portion of the lighting housing.

9. The fixture of claim 7, wherein the cover extends between outer edges of the elongate opening.

10. The fixture of claim 7, wherein the cover is located at least partially within the elongate housing.

11. The fixture of claim 7, wherein the base portion and the support substrate are located entirely within the elongate housing.

12. The fixture of claim 7, wherein the cover is located at least partially out of the elongate housing.

13. The fixture of claim 1, wherein at least one electric component is mounted on the second face of the light module such that the at least one electric component is located in a space within the bounds of the inner surface of the elongate housing, the first and second walls, and the second face of the light module.

14. The fixture of claim 1, wherein a second light module is retained longitudinally adjacent to a first light module by another plurality of retainer means within the elongate housing.

15. The fixture of claim 14, wherein a lighting driver is mounted on the second face of the first light module, wherein the lighting driver is configured to control the provision of power to the at least one LED of the first light module and the second light module.

16. The fixture of claim 1, wherein at least the first or second wall is composed of a first portion of the elongate housing extending towards the elongate opening and joining to another second portion of the elongate housing extending at an angle of the first portion, such that an external compartment for receiving cables and wires is created.

17. The fixture of claim 1, wherein the first face of the light module is designed to align with the outer edges of the elongate opening when mounted within the elongate housing.

18. The fixture of claim 1, wherein the elongate housing is an extruded profile, preferably in metal.

19. The fixture of claim 1, wherein the elongate housing comprises an outer casing in which the elongate opening is arranged; wherein at least the first wall is arranged in the outer casing, such that a compartment delimited by the outer casing and the first wall is created.

20. A lighting fixture comprising:

an elongate housing having an outer surface and an inner surface and having an elongate opening extending in a longitudinal direction of the housing;

wherein the elongate housing comprises a first wall and a second wall extending towards the elongate opening;

a light module for emitting light having a first face through which light is emitted and an opposite second face;

a plurality of retainer means provided at the second face and configured for engaging the first and second walls such that the light module is retained within the elongate housing;

a stopper means for preventing inward displacements of the light module past a predetermined boundary;

wherein the light module comprises:

a support substrate with at least one LED disposed thereon;

a lighting housing comprising a base portion and a cover;

said cover extending over the at least one LED and being fixed to said base portion, wherein the cover is located at least partially within the elongate housing, and wherein the base portion is located entirely within the elongate housing;

wherein at least one electric component is mounted on the second face of the light module such that the at least one electric component is located in a space within the bounds of the inner surface of the elongate housing, the first and second walls, and the second face of the light module.

21. The lighting fixture of claim 20, wherein the support substrate is located entirely within the elongate housing.

22. The lighting fixture of claim 20, wherein the elongate housing has a planar support surface to fix the housing to a wall, said first side wall extending from the support surface, said second side wall extending from the support surface opposite of the first side wall, wherein the at least one electric component is located in a space between the first side wall and the second side wall.

* * * * *